US007040037B2

(12) United States Patent
Keong

(10) Patent No.: US 7,040,037 B2
(45) Date of Patent: May 9, 2006

(54) HAIRDRYER DIFFUSER

(75) Inventor: Michael Wai Ho Keong, Hong Kong Sar (CN)

(73) Assignee: Kenford Industrial Company Limited, Hong Kong (CN)

( * ) Notice: Subject to any disclaimer, the term of this patent is extended or adjusted under 35 U.S.C. 154(b) by 0 days.

(21) Appl. No.: 10/851,940

(22) Filed: May 21, 2004

(65) Prior Publication Data

US 2005/0257395 A1 Nov. 24, 2005

(51) Int. Cl.
*A45D 20/12* (2006.01)

(52) U.S. Cl. ..... 34/97

(58) Field of Classification Search ..... 34/96, 34/97, 98, 99, 100; 132/206, 220; 392/384, 392/385; 239/555.3, 590
See application file for complete search history.

(56) References Cited

U.S. PATENT DOCUMENTS

| | | | | |
|---|---|---|---|---|
| 5,275,339 | A * | 1/1994 | Andis et al. | 239/443 |
| 5,488,783 | A * | 2/1996 | Parkinson et al. | 34/98 |
| 5,526,578 | A * | 6/1996 | Iyer | 34/97 |
| 5,725,159 | A * | 3/1998 | Dorber et al. | 239/553.3 |
| 5,857,379 | A * | 1/1999 | Lulofs et al. | 73/73 |
| D429,374 | S * | 8/2000 | Muller | D28/18 |

FOREIGN PATENT DOCUMENTS

GB 2 211 732 * 7/1989

* cited by examiner

*Primary Examiner*—S. Gravini
(74) *Attorney, Agent, or Firm*—Alix, Yale & Ristas, LLP

(57) ABSTRACT

A diffuser for a handheld electric hairdryer, includes a base from which a plurality of fingers extend, each finger having a longitudinal through-passage through which hot air passes from the base. There is attached to the base a thermal-capacitance element to moderate changes in temperature of air exhausted through the diffuser.

8 Claims, 4 Drawing Sheets

HAIRDRYER DIFFUSER

BACKGROUND OF THE INVENTION

The present invention relates to hairdryer diffusers. More particularly, although not exclusively, the invention relates to an air diffuser for use with an electric hairdryer having a heat-retentive element.

It is known to provide diffusers for the hot air outlet nozzle of handheld electric hairdryers. These are designed to diffuse the hot airflow over a broader area of hair than would otherwise be achieved without the diffuser, for providing a gentle and broad drying effect. Most such diffusers are limited in their degree of effectiveness in diffusing the airflow. For example, some such diffusers provide a flat base through which the areas diffused through a plurality of apertures and from which a number of hair-penetrating fingers extend. The air having passed through the aperture plates is intended to slow about the fingers. However, as these fingers are at covered by hair in use, the hair actually blocks the flow path.

Another problem associated with known air diffusers is that may provide no means of stabilizing the temperature of the diffused air. As a result, as the hairdryer is activated and deactivated throughout a session, the temperature can fluctuate up and down quite significantly.

OBJECTS OF THE INVENTION

It is an object of the present invention to overcome or substantially ameliorate at least one of the above disadvantages and/or more generally to provide an improved hot air diffuser for a handheld electric hairdryer.

DISCLOSURE OF THE INVENTION

There is disclosed herein a diffuser for a handheld electric hairdryer, comprising a base from which a plurality of fingers extend, each finger comprising a longitudinal through-passage through which hot air passes from the base.

Preferably, each finger comprises an outlet aperture extending from a tip of the finger toward the base.

Preferably, the fingers extend from the base in a circular array or concentric arrays somewhat like the petals of a flower.

Preferably, the outlet apertures face toward the centre of the array(s).

Preferably, the diffuser comprises an inner array of fingers and an outer array of fingers, and further comprises a first air inlet in communication with the inner array of fingers and an annular second air inlet surrounding the first air inlet and in communication with the outer array of fingers.

Preferably, there is attached to the base a thermal-capacitance element to moderate changes in temperature of air exhausted through the diffuser.

Preferably, the diffuser has one or more apertures to allow hot air to flow therethrough.

Preferably, the thermal-capacitance element is surrounded by the fingers.

Preferably, the element is formed of a material selected from the group consisting of ceramic, metal and glass.

The diffuser might be formed integrally with a hairdryer body, or formed as an attachment for a hairdryer body.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
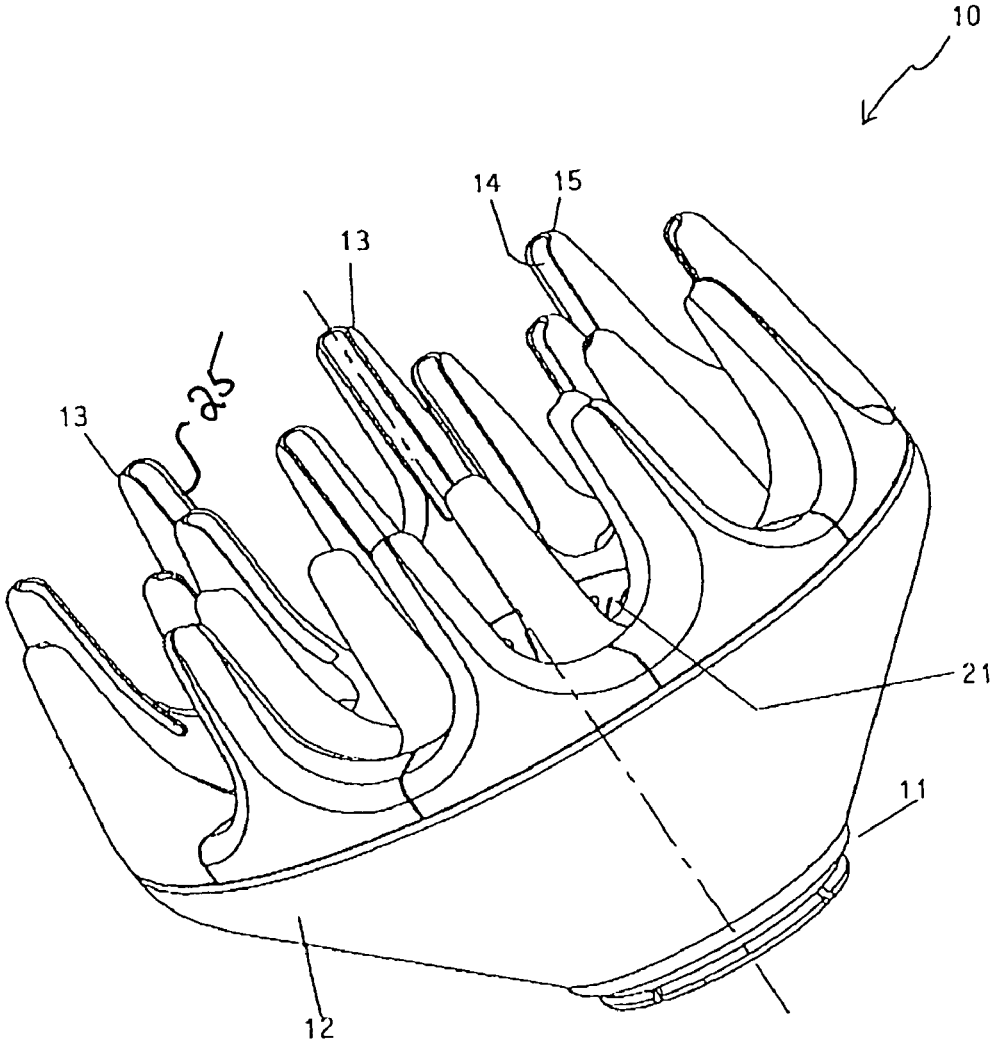
FIG. 1 is a schematic perspective illustration of a diffuser.
Figure 3:
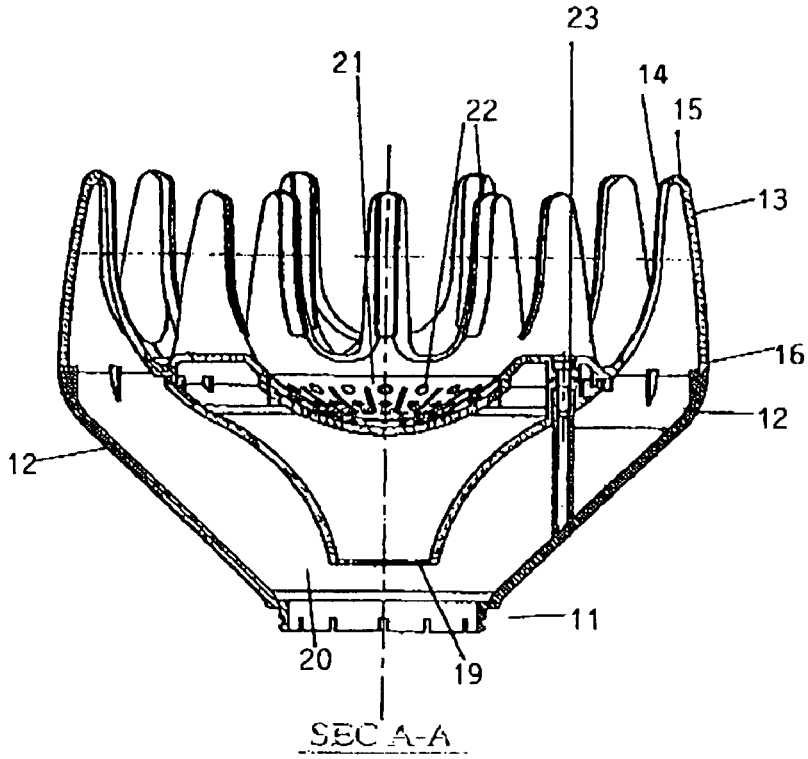
FIG. 3 is a schematic cross-sectional elevation of the diffuser taken at III—III in FIG. 2, FIG. 4 in a schematic cross-sectional elevation like that of FIG. 3, showing the air flow path therethrough, and FIG. 5 in a schematic cross-sectional elevation like that of FIG. 4 of an alternative embodiment.
Figure 2:
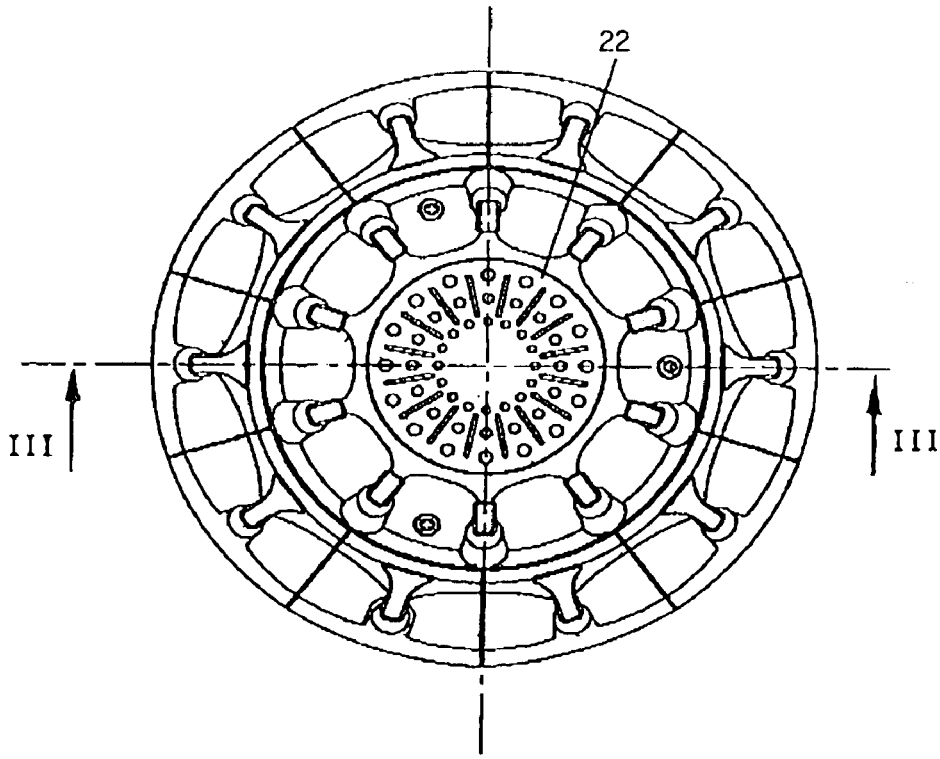
FIG. 2 is a schematic front elevation of the diffuser of FIG. 1.

In the accompanying drawings there is depicted schematically a diffuser 10 typically forms of moulded plastic material and comprising a flange 11 by which it can be attached to the outlet nozzle of a handheld electric hairdryer (not shown).

The diffuser comprises a base 12 from which there extends a plurality of fingers 13. Each finger has an elongated outlet aperture 14 extending from a tip 15 down an inside edge 25 thereof. The fingers 13 might be formed integrally with the base 12, or be formed as a separate part secured to the base 12 at joining 16 by means of screws 23.

The fingers 13 are provided in two concentric circular arrays comprising and inner array 17 and an outer array 18.

Figure 4:
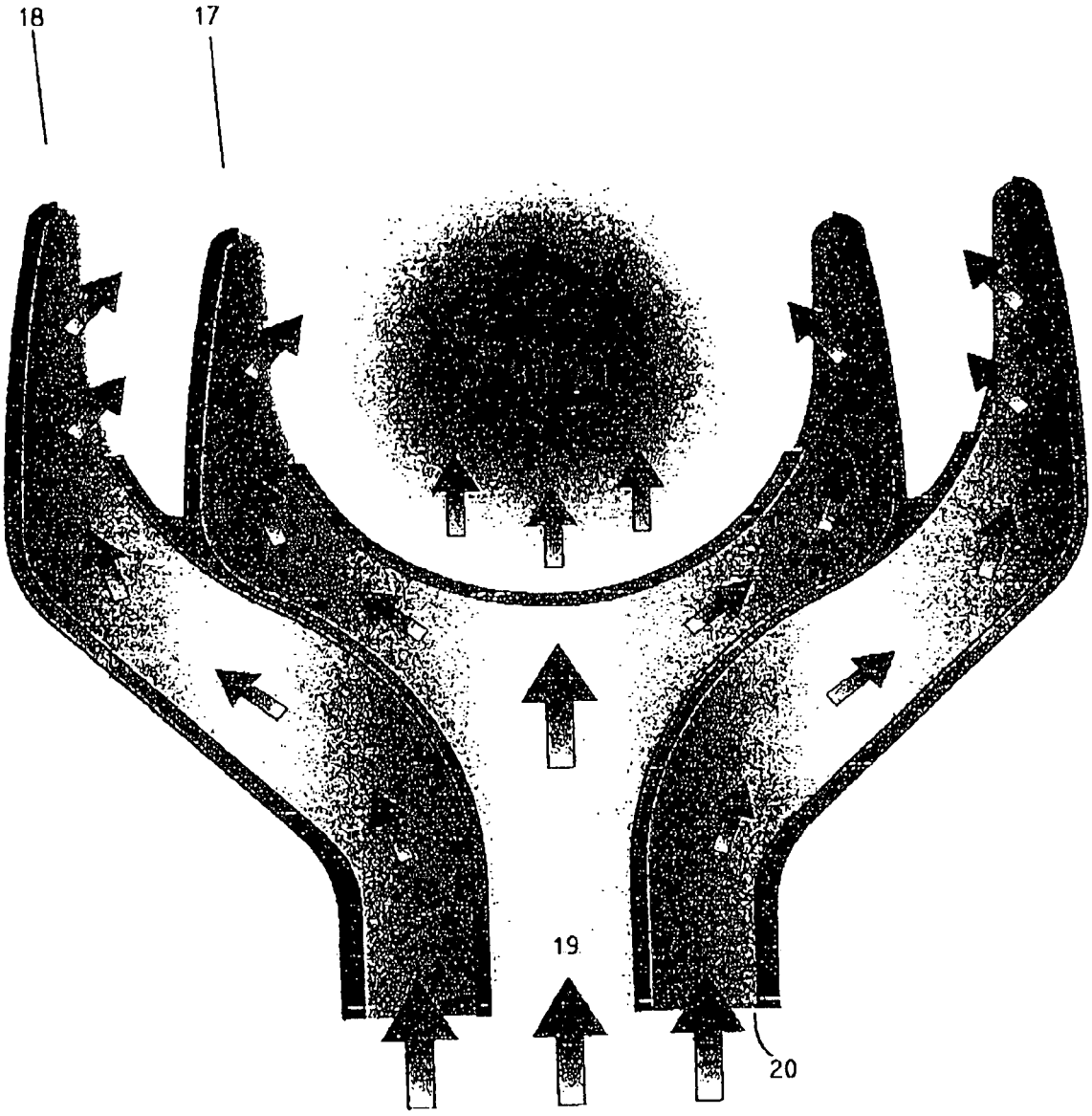
Figure 5:
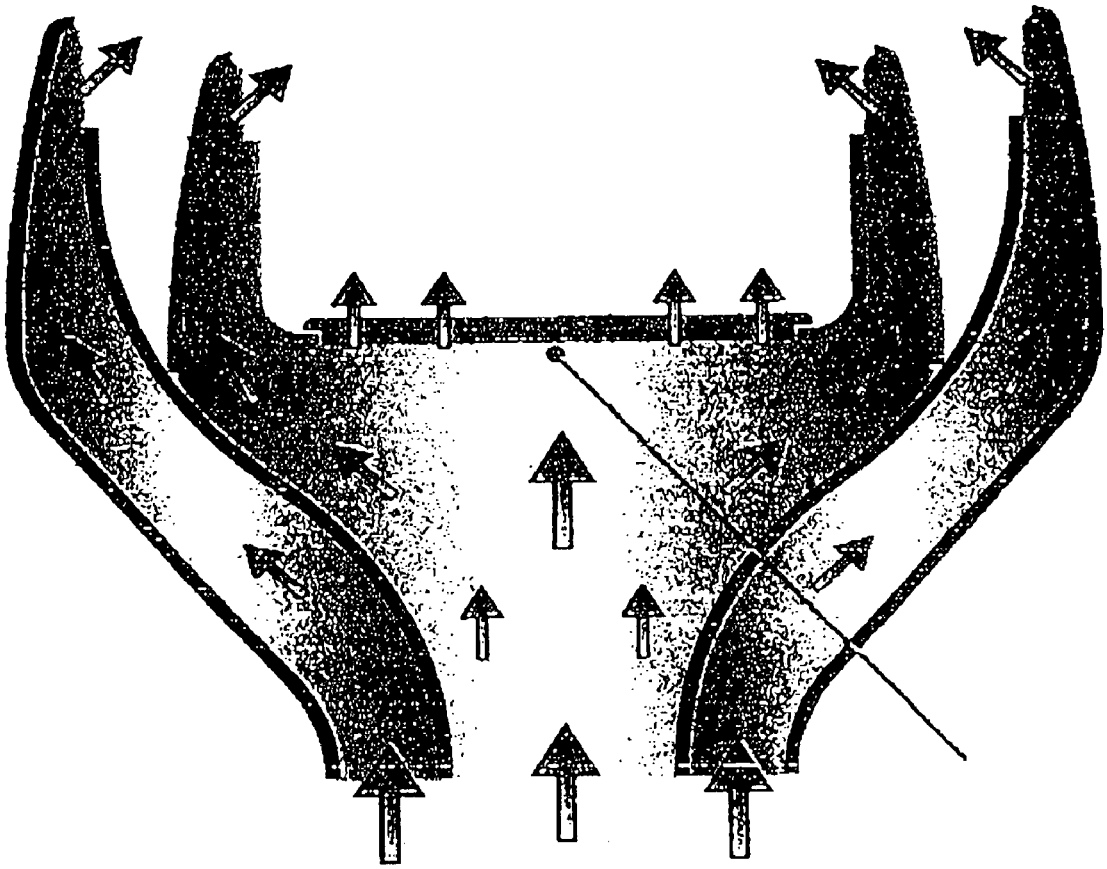

Inside the flange 11 is a first or central inlet passage 19 through which hot air from the hairdryer passes to the inner array 17 of fingers. This is surrounded by an annular passage through which hot air from the hairdryer passes to the outer array 18 of fingers. The respective airflow paths are shown in FIGS. 4 and 5.

There is a thermal capacitance element 21 secured upon the base 12 centrally of the arrays of fingers. This element might be concave in shape as shown in FIG. 4 for example, or flat as shown in FIG. 5. The thermal capacitance element might be made of ceramic, metal, glass or other heat-retentive material and comprises a plurality of apertures 22—some of which are in the form of a radially extending slots, and others of which are circular. Some of the air flowing through the central Inlet passage in 19 passes through the thermal capacitance element, rather than continuing on to pass through the inner array of fingers.

In use, the diffuser would be attached to all formed integrally with the nozzle of a handheld electric hairdryer. As hot air passes across and through the thermal capacitance element, it gains and retains heat. If the hairdryer is momentarily stopped, this heat is retained until the hairdryer is reactivated at which time heat therein is transferred to the airflow passing through the apertures or flowing immediately thereunder en route to the inner array of finger. As the diffuser is passed through the hair, airflow continues through the elongated outlet apertures 14 to impinge upon the hair to thereby dry it.

It should be appreciated that modifications and alterations obvious to those skilled in the art are not to be considered as beyond the scope of the present invention. For example, instead of providing a central inlet passage and an angular passage surrounding it, a single air inlet might communicate with both the inner and outer array of fingers and the heat retention element.

The invention claimed is:

1. A diffuser for handheld electric hairdryer, comprising a base from which a plurality of fingers extend in a circular array defining a center, each finger comprising a longitudinal through-passage through which hot air passes from the base, an outlet aperture longitudinally extending along an inside edge, from a tip of each finger toward the base, wherein each outlet aperture faces toward the center.

2. The diffuser of claim 1, wherein the fingers extend from the base in a circular array or concentric arrays somewhat like the petals of a flower.

3. The diffuser of claim 1 comprising an inner array of fingers and an outer array of fingers, and wherein the diffuser comprises a first air inlet in communication with the inner array of fingers and an annular second air inlet surrounding the first air inlet and in communication with the outer array of fingers.

4. The diffuser of claim 1, wherein there is attached to the base a thermal-capacitance element to moderate changes in temperature of air exhausted through the diffuser.

5. The diffuser of claim 4, wherein the thermal-capacitance element is surrounded by the fingers.

6. The diffuser of claim 4, wherein the element is formed of a material selected from the group consisting of ceramic, metal and glass.

7. The diffuser of claim 4, wherein the element has one or more apertures to allow hot air to flow thereth rough.

8. The diffuser of claim 1 being formed integrally with a hairdryer body, or formed as an attachment for a hairdryer body.

* * * * *